US009750965B2

(12) United States Patent
Marlin

(10) Patent No.: US 9,750,965 B2
(45) Date of Patent: Sep. 5, 2017

(54) DEVICE FOR SPRAYING A LIQUID

(71) Applicant: HERAKLES, Le Haillan (FR)

(72) Inventor: Frederic Marlin, Saint Medard en Jalles (FR)

(73) Assignee: HERAKLES, Le Haillan (FR)

( * ) Notice: Subject to any disclaimer, the term of this patent is extended or adjusted under 35 U.S.C. 154(b) by 241 days.

(21) Appl. No.: 14/411,829

(22) PCT Filed: Jun. 27, 2013

(86) PCT No.: PCT/FR2013/051501
§ 371 (c)(1),
(2) Date: Dec. 29, 2014

(87) PCT Pub. No.: WO2014/001722
PCT Pub. Date: Jan. 3, 2014

(65) Prior Publication Data

US 2015/0165251 A1 Jun. 18, 2015

(30) Foreign Application Priority Data

Jun. 29, 2012 (FR) ..... 12 56243

(51) Int. Cl.
*A62C 37/10* (2006.01)
*A62C 35/02* (2006.01)
(Continued)

(52) U.S. Cl.
CPC ..... *A62C 35/023* (2013.01); *A62C 5/006* (2013.01); *A62C 13/22* (2013.01); *A62C 37/44* (2013.01);
(Continued)

(58) Field of Classification Search
CPC ..... A62C 35/023; A62C 5/006; A62C 13/22; A62C 37/44; A62C 13/003; B05B 7/0006; B05B 7/0475; B05B 7/068
(Continued)

(56) References Cited

U.S. PATENT DOCUMENTS 3,486,562 A * 12/1969 Goodloe ..... A62C 99/0018 169/11
5,845,716 A 12/1998 Birk
(Continued)

FOREIGN PATENT DOCUMENTS

EP 0784998 7/1997
EP 0956883 11/1999
(Continued)

OTHER PUBLICATIONS

Japanese Office Action issued in Japanese corresponding application No. 2015-519298 dated Nov. 28, 2016 (9 pages; English translation).

*Primary Examiner* — Arthur O Hall
*Assistant Examiner* — Adam J Rogers
(74) *Attorney, Agent, or Firm* — Hamre, Schumann, Mueller & Larson, P.C.

(57) ABSTRACT

A spray device (100) for spraying a liquid (L), the device comprises a tank (10) containing the liquid (L) for spraying, at least one liquid ejector member (20) in communication with said tank (10), and a pyrotechnic gas generator (30) for pressurizing the liquid inside said tank and propelling it under pressure out from said tank. According to the invention, in at least one mode of operation, the ejector member (20) is in communication with the gas generator (30) in such a manner as to enable it to be fed with the gas generated by said generator (30).

13 Claims, 3 Drawing Sheets

(51) Int. Cl.

| | |
|---|---|
| ***B05B 7/00*** | (2006.01) |
| ***B05B 7/04*** | (2006.01) |
| ***B05B 7/06*** | (2006.01) |
| ***A62C 13/22*** | (2006.01) |
| ***A62C 5/00*** | (2006.01) |
| ***A62C 37/44*** | (2006.01) |
| *A62C 13/00* | (2006.01) |

(52) U.S. Cl.
CPC ..... *B05B 7/0006* (2013.01); *B05B 7/0475* (2013.01); *B05B 7/068* (2013.01); *A62C 13/003* (2013.01)

(58) Field of Classification Search
USPC ..... 239/61, 373; 169/61, 84
See application file for complete search history.

(56) References Cited

U.S. PATENT DOCUMENTS

| | | | | |
|---|---|---|---|---|
| 5,934,380 | A * | 8/1999 | Finnerty | A62C 5/008 169/46 |
| 6,513,602 | B1 * | 2/2003 | Lewis | A62C 5/006 149/19.1 |
| 8,408,322 | B2 * | 4/2013 | Blau | A62D 1/06 169/30 |
| 2009/0159300 | A1 * | 6/2009 | Fabre | A62C 35/023 169/9 |
| 2009/0202364 | A1 * | 8/2009 | Bodart | A62C 13/22 417/158 |
| 2010/0236796 | A1 * | 9/2010 | Chattaway | A62C 37/44 169/46 |
| 2012/0273240 | A1 * | 11/2012 | Smith | A62C 37/48 169/70 |

FOREIGN PATENT DOCUMENTS

| | | |
|---|---|---|
| EP | 1782861 | 5/2007 |
| FR | 2936715 | 4/2010 |
| GB | 2028127 | 3/1980 |
| JP | 9-192252 | 7/1997 |
| JP | 2008-522696 | 7/2008 |
| JP | 2009-297589 | 12/2009 |
| WO | WO 93/15793 | 8/1993 |
| WO | WO 2006/134311 | 12/2006 |
| WO | WO 2007/042735 | 4/2007 |
| WO | WO 2009/095578 | 8/2009 |

* cited by examiner

DEVICE FOR SPRAYING A LIQUID

The invention relates to a device for spraying a liquid.

The device of the present invention is adapted in particular for spraying a liquid of high viscosity, such as oil or paint, or indeed certain extinguishing agents.

A particularly advantageous application of the invention lies in the field of extinguishing fire.

In the field of fire extinction, it is known to expel an extinguishing agent contained in a tank under the action of hot gas generated by a pyrotechnic gas generator, the extinguishing agent leaving the tank being taken to an ejector member. Under the effect of high temperature, the agent diffused into the fire zone evaporates, contributing both to extinguishing the fire and to preventing it from spreading.

By way of example, in patent FR 2 936 715, there is described a device comprising a cylindrical body housing a slidable piston defining on one side a chamber forming a tank filled with the extinguishing agent and on the other side a chamber containing a gas generator. When the gas generator is actuated, the pressure of the gas moves the piston so that the extinguishing agent is expelled out from the tank so that it goes to the ejector member.

The temperature of the extinguishing agent stored in the tank of such a spray device will vary considerably depending on the environment in which said device is to be found. For example, when the spray device is on board an airplane, the temperature of the extinguishing agent may drop considerably. Under such circumstances, once it has been sprayed, the agent takes time to evaporate. The distance traveled by the extinguishing agent prior to evaporating is also longer. Furthermore, the viscosity and the density of the extinguishing agent are increased, thereby leading to poorer atomization at given pressure and for the same ejector member. The increase in the viscosity of the extinguishing agent also leads to an increase in the size of the droplets that are sprayed, and that contributes to further increasing the time required for the agent to evaporate in the fire zone.

It can happen in particular that the sprayed droplets, instead of evaporating in the fire zone, strike a cold surface situated further away and then flow along the surface. Thus the necessary concentration of extinguishing agent is not achieved and the fire is not extinguished.

In the light of that prior art, an object of the invention is to provide a spray device that provides good atomization over a wide range of operating temperatures, in particular when cold, and that is suitable for being used even with a liquid that is highly viscous.

This object is achieved with a spray device for spraying a liquid, the device comprising a tank containing the liquid for spraying, at least one liquid ejector member in communication with said tank, and a pyrotechnic gas generator for pressurizing the liquid inside said tank and propelling it under pressure out from said tank, the device being characterized in that in at least one mode of operation, the ejector member is also in communication with the gas generator in such a manner as to enable it to be fed with the gas generated by said generator.

The ejector member of the spray device of the invention is thus adapted to be fed both with the liquid for spraying and also with the combustion gas, the liquid and gas circuits joining together to create turbulence inside the ejector member or at its outlet. Under the effect of being mixed with the gas, the liquid is dispersed in the form of fine droplets. In the present description, when liquid and gas are said to be "mixed", it should be understood that the liquid is put into aerodynamic contact with the gas, in particular for a period that is short or at a speed that is high. Under the effect of aerodynamic shear, the liquid is separated into microdroplets.

By virtue of these provisions, the device provides good atomization of the liquid even when the liquid presents high viscosity.

Furthermore, since the gas feeding the ejector member is hot, given that it comes from a pyrotechnic gas generator, it serves to heat the liquid with which it is mixed so as to reduce its viscosity and further improve its atomization.

In an example, the ejector member is a two-fluid nozzle. The term "two-fluid nozzle" is used herein to mean a nozzle that is fed by a first circuit for delivering a flow of liquid that is to be sprayed and by a second circuit for delivering a flow of gas (the path followed by the gas having a radial component relative to the travel direction of the liquid), and configured to put the liquid and the gas into contact and thus to break up the liquid into fine droplets. Such a nozzle is said to perform internal mixing when the liquid and the gas mix inside the nozzle and external mixing when the mixing takes place outside and on leaving the nozzle.

In an example, the device of the invention is a fire extinguisher, and said liquid is then an extinguishing agent. Under such circumstances, the great majority of the combustion gas generated by the pyrotechnic gas generator is constituted by $CO_2$, $N_2$, and $H_2O_{(g)}$, so the combustion gas injected into the nozzle and thus delivered on the fire together with the sprayed liquid can also contribute to increasing the extinction effectiveness of the device. The combustion gas injected into the nozzle is made even more effective by being cooled by exchanging heat with the liquid in the nozzle.

In an example, the gas generator is located at least in part inside the tank. In this way, a portion of the gas that is generated can be delivered easily and directly into the inside of the tank.

In an example, the gas generator is configured for the gas that is released to act directly on the liquid.

In an example, the gas generator is configured for the gas to act indirectly on the liquid via a movable separator member.

For example, the movable separator member is a deformable membrane, in particular a flexible membrane. This provision limits constraints on fabricating the device. Nevertheless, this example is not limiting. Thus, in another example, and if the gas generator and the tank are appropriately configured, the separator member may be a slidable piston defining two spaces, one constituting a combustion chamber housing a pyrotechnic charge and the other constituting a tank of liquid for spraying.

In an example, the gas generator has at least one combustion chamber housing a pyrotechnic charge and a pressurization chamber communicating with said combustion chamber via at least one gas-passing orifice, the pressurization chamber being defined by the movable separator member.

The gas feeding the ejector member is preferably taken directly from the combustion chamber and not from the pressurization chamber, in order to facilitate controlling its pressure and/or flow rate.

Thus, according to an advantageous provision, the gas generator comprises at least one combustion chamber housing a pyrotechnic charge, the ejector member is a nozzle, and, in at least one mode of operation, the nozzle is in direct communication with said combustion chamber.

In a particular embodiment, the gas generator comprises a combustion chamber housing at least one pyrotechnic charge, said combustion chamber being arranged so that a portion of the gas generated in said chamber acts on the liquid to pressurize it and to propel it out from the tank, and so that, in at least mode of operation, another portion of the gas generated in the chamber feeds the ejector member, in particular in order to be mixed with said liquid therein.

By means of these provisions, only one gas source is used both for pressurizing the liquid contained in the tank and for feeding the nozzle with gas. In this example, the device also presents the advantage of enabling the tank and the gas generator to be depressurized via the outlet orifice(s) of the ejector member, at the end of operation.

In another embodiment, the gas generator has a first gas generator unit having a first combustion chamber housing at least one first pyrotechnic charge, and a second gas generator unit comprising a second combustion chamber housing at least one second pyrotechnic charge, said first gas generator unit being arranged in such a manner that the gas generated in said first combustion chamber acts on the liquid to pressurize it and to propel it out from the tank, and said second gas generator unit being arranged so that, in at least one mode of operation, the gas generated in said second combustion chamber feeds the liquid ejector system, in particular in order to be mixed with said liquid therein.

In this example, the tank, which communicates with a first flow circuit of the ejector member, is coupled with the first combustion chamber (i.e. the combustion chamber of the first gas generator unit), while the second combustion chamber (i.e. the chamber of the second gas generator unit) feeds gas to the second gas flow circuit of the ejector member.

In an embodiment, the pyrotechnic gas generator includes an ignitor adapted to cause the first pyrotechnic charge of the first gas generator unit and the second pyrotechnic charge of the second gas generator unit to fire jointly.

In another embodiment, the pyrotechnic gas generator includes a first ignitor adapted to fire the first pyrotechnic charge, and a second ignitor adapted to fire the second pyrotechnic charge independently of the first.

Under such circumstances, the spray device may include a control system, in particular an electrical control system, adapted to trigger the first and second ignitors, in synchronous or asynchronous manner.

Controlling the way the first and second ignitors are triggered can thus serve to synchronize the arrival of liquid and gas in the nozzle.

In an embodiment, the spray device includes a temperature sensor inside the tank and a control member controlling the actuation of the second ignitor as a function of the temperature value measured inside the tank.

In another embodiment, the spray device further includes a valve for controlling the flow rate of gas delivered into the ejector member and a temperature sensor situated inside the tank, said valve being controlled as a function of the temperature measured by said sensor.

Various embodiments are described below. Nevertheless, unless specified to the contrary, characteristics described with any one embodiment may be applied to any other embodiment.

The invention can be better understood, and its other advantages appear more clearly, in the light of the following description of presently preferred embodiments of a device in accordance with the principle of the invention, given purely by way of example and described with reference to the accompanying drawings, in which:

FIG. 1 is a diagram showing a spray device (referred to below as a "device") 100 in a first embodiment of the present invention.

Figure 1:
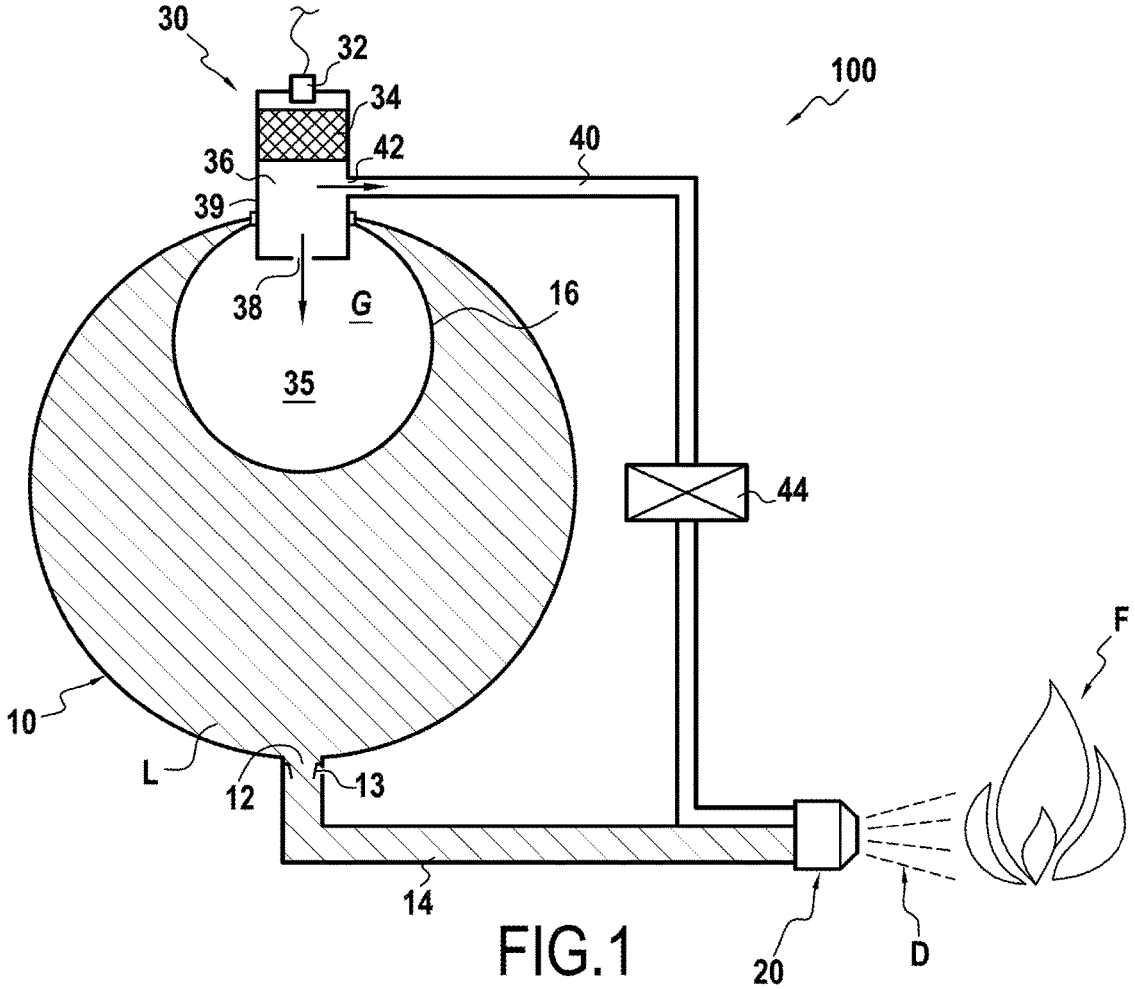
FIG. 1 is a diagrammatic view of a spray device in a first embodiment of the present invention.

The spray device 100 mainly comprises a tank 10 containing a liquid L, a pyrotechnic gas generator 30, and an ejector member 20 for ejecting the liquid L.

The gas generator 30 comprises a main body 39 that forms a combustion chamber 36 housing a pyrotechnic charge 34. It also includes an ignitor 32 capable of being triggered by a control unit, in particular an electrical control unit (not shown) that is adapted, on being actuated, to fire said charge 34.

In the example, the gas generator 30 is contained in part inside the tank 10. As shown in FIG. 1, the combustion chamber 36 communicates via a through orifice 38 in the main body 39 with a space constituting a pressurization chamber 35 situated inside the tank and defined by a movable separator member 16.

In this way, a portion of the gas G generated in the combustion chamber 36 when it is in put into operation is delivered directly into the inside of the tank 10, into the pressurization chamber 35 of the generator 30, and the movable separator member 16 separates the pressurization chamber containing the gas G generated by the generator 30 from the liquid L contained in the tank 10.

By way of example, the separator member 16 is a flexible membrane suitable for deforming under the effect of the pressure of the gas G in order to transmit the pressure to the liquid L contained in the tank 10.

It should also be observed that the tank 10 is provided with a member for delivering the liquid L, in particular a frangible membrane 13, that opens beyond a certain pressure of said liquid L.

When the pyrotechnic generator 30 is put into operation, the gas G coming from the combustion chamber and contained in the pressurization chamber acts on the surface of the liquid via the separator member 16, thereby avoiding contact between the liquid and the gas, and thus avoiding an emulsion being formed.

Beyond a certain pressure threshold (pressure generated by the gas G and transmitted by the liquid L), the delivery member 13 opens and the liquid L is delivered under pressure into a pipe 14 connecting the tank 10 to the ejector member 20.

In this example, the device is a fire extinguisher and the liquid L is an extinguisher agent, in particular of the non-flammable hydrofluoroether (HFE) type, as described in patent application EP 1 782 861. This type of material presents the advantage of providing high quality fire extinction without any ecological impact.

The pyrotechnic charge 34 may be constituted for example by a compound such as the compounds described in patent applications WO 2006/134311 or WO 2007/042735, and in particular those that are constituted essentially by guanidine nitrate and basic copper nitrate which are well adapted to the context of the present invention. The person skilled in the art knows how to adapt the shape, the weight, and the composition of the pyrotechnic charge 34 as a function of the desired delivery rates and operating times.

As can be seen in FIG. 1, the pyrotechnic gas generator 30 also includes at least one orifice 42 of diameter adapted to the desired gas flow rate, leading out from the combustion chamber 36 and connected to a duct 40 for feeding the liquid ejector member 20. Throughout the description below, the combustion gas outlet orifice(s) communicating with the ejector member 20 is/are referred to as "leakage orifice(s)".

Although the pyrotechnic charge is preferably selected from compounds that generate little or no solid effluent, it is not impossible that solid particles will be produced and entrained via the duct 40 towards the ejector member 20. A particle filter 44 is thus advantageously installed in the duct 40 feeding the ejector member 20 in order to prevent it from becoming clogged with solid particles coming from the gas generator 30.

Figure 2A:
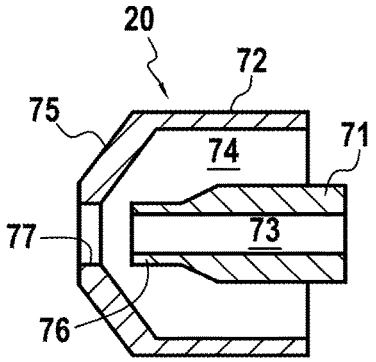
FIG. 2A is an axial section view of the ejector member of FIG. 1, in an embodiment.

The ejector member 20, fed with the extinguishing agent L contained in the tank 10 via the duct 14 and with gas coming from the combustion chamber 36 via the duct 40 is shown in greater detail in FIG. 2A.

In this example, the ejector member 20 is a nozzle of the "two-fluid" type. In this example it has two coaxial tubes 71 and 72 defining an inner flow circuit 73 defined by the tube 71 of smaller diameter, and an outer flow circuit 74 defined between the outside face of the tube 71 and the inside face of the larger-diameter tube 72.

The inner flow circuit 73 is connected to the duct 14 communicating with the tank 10 and the outer flow circuit 74 is connected to the duct 40 communicating with the combustion chamber 36.

In this example, the two-fluid nozzle 20 is an internal mixing nozzle, i.e. aerodynamic contact is established between the gas and the liquid inside the nozzle 20.

For this purpose, in the example shown, the outer tube 72 has a constriction 75 at its distal end. The distal end 76 of the inner tube 71 is situated inside the outer tube 72, immediately upstream from its constriction 75. The two tubes 71 and 72 thus have their ends offset relative from each other so that the streams of liquid and gas converge inside the nozzle and come into dynamic contact prior to leaving the nozzle via the opening 77 of the outer tube 72.

It should be observed that since the flow section of the gas is reduced in the vicinity of the outlet of the inner tube 71, the gas is ejected at very high speed towards the extinguishing agent coming from the tube 71, and as a result the extinguishing agent L is dispersed through the opening 77 in the form of fine droplets D (see FIG. 1).

Figure 2B:
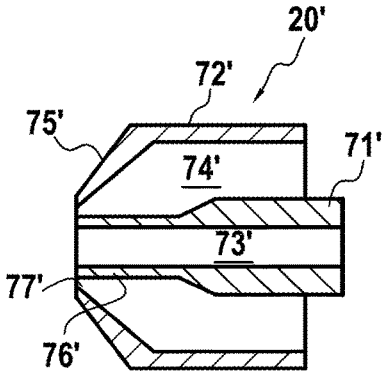
FIG. 2B shows another element of the ejector member.

Another example of a nozzle 20' suitable for use in the spray device of the present invention is described below with reference to FIG. 2B. Elements having the same function as in FIG. 2A are given the same numerical references together with a prime sign.

The nozzle 20' differs from the nozzle 20 of FIG. 2A in that mixing between the gas and the liquid takes place by the two streams coming respectively from the inner flow circuit 73' and from the outer flow circuit 74' converging at the outlet from the nozzle 20'. This is referred to as a two-fluid nozzle with external mixing.

Since the two tubes 71 and 72 have their ends level, the gas and the liquid leave the nozzle before being able to mix together.

As in the above-described example, the outer tube 72' is constricted at its end, such that its flow section decreases progressively. The reduction in the flow section of the gas leads to an increase in the speed of the gas, thereby improving the effectiveness of the mixing.

The operation of the spray device 100 is described below in greater detail.

The spray device 100 is actuated by triggering the ignitor 32 and as a result by combustion of the pyrotechnic charge 34 inside the combustion chamber 36.

Under the effect of pressure, the gas resulting from this combustion escapes via the through orifice 38 in the main body 39 and penetrates into the pressurization chamber 35 contained inside the tank 10, which chamber is defined in this example by the deformable membrane 16 and by the main body 39 of the gas generator.

As a result of the gas expanding, the membrane 16 deforms progressively and the volume of the pressurization chamber 35 increases. The pressure of the gas G is transmitted to the extinguishing agent L via the membrane 16.

Under the effect of the pressure of the liquid L, the delivery member 13 opens and the agent is propelled out from the tank 10 through its opening 12 leading to the duct 14.

Simultaneously, a portion of the gas contained in the combustion chamber 36 passes via the orifice 42 and travels along the duct 40 to the spray nozzle 20.

Since this gas is still hot, it transmits its heat to the extinguishing agent L once in the nozzle 20. As a result, the combustion gas is cooled while the extinguishing agent is heated causing its viscosity to decrease.

The gas and the liquid finally come into contact such that the liquid is sprayed out from the nozzle 20 in the form of fine droplets D that are preferably directed towards the fire F that is to be extinguished.

It can be understood that the stream of gas is set into turbulence in the zone where the liquid reaches the nozzle. The gas breaks up the liquid and projects microdroplets towards the target.

After operation, the combustion chamber 36 is depressurized via the outlet orifice from the nozzle 20. Additional depressurization members may be provided but they are nevertheless not essential.

Figure 3:
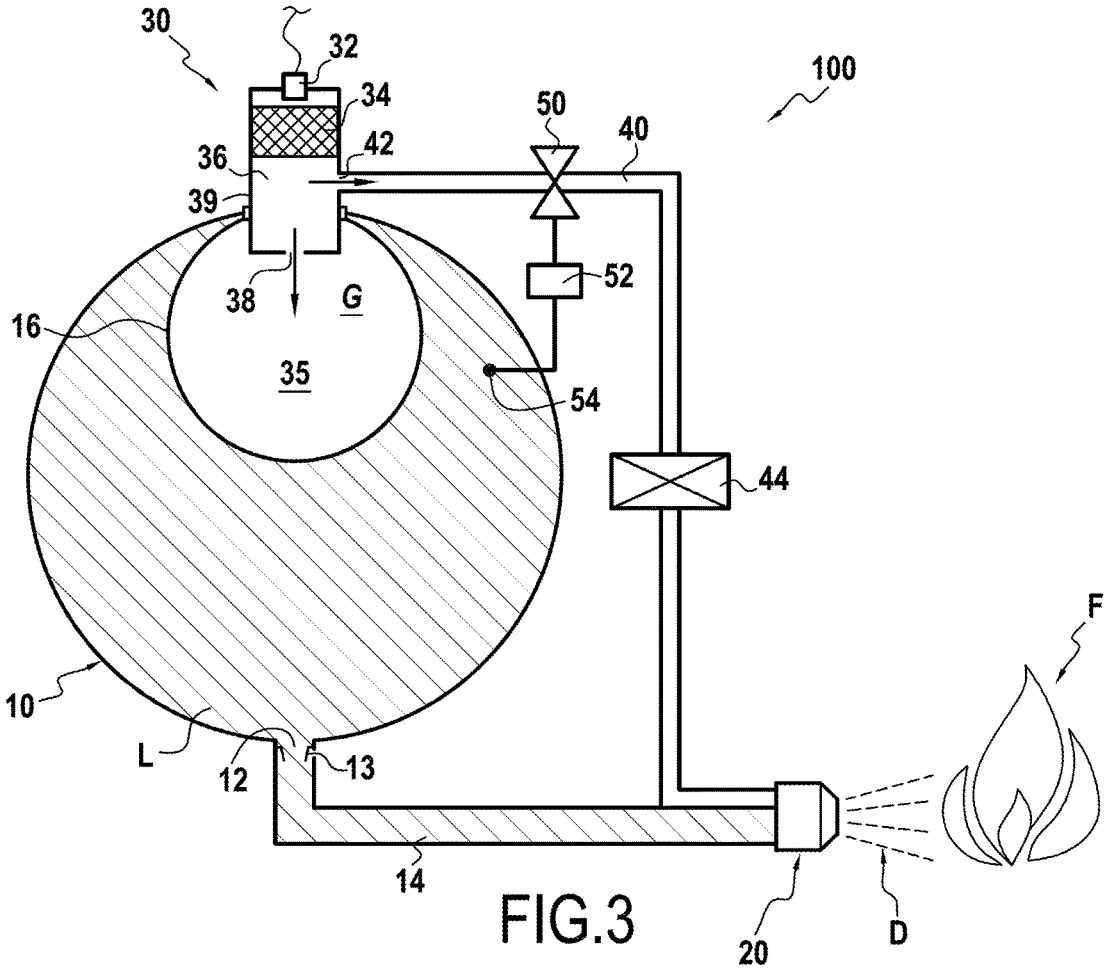
FIG. 3 shows an advantageous variant of the FIG. 1 spray device.

FIG. 3 shows the same spray device 100 in an advantageous variant embodiment.

In this embodiment, the device 100 also has a temperature sensor 54 situated inside the tank 10 and preferably in contact with the liquid L contained in the tank, a controllable valve 50 in the gas transport duct 40, and a control member 52 for controlling the valve as a function of the value(s) measured by the temperature sensor 54. Thus, depending on the temperature of the liquid L and thus on its viscosity, the valve 50 is controlled to adjust the gas flow rate and to ensure that the appropriate quantity of gas is injected into the nozzle 20 for ensuring the required quality of atomization of the liquid.

Under certain circumstances, the liquid L for spraying presents viscosity that is low enough and in general terms a temperature that is high enough to ensure that it diffuses correctly without any prior heating or mixing with the gas. The gas control member could then cause the valve to be closed completely during spraying and the nozzle could then function as a nozzle for a single fluid that is liquid. Under such circumstances, the device should be provided with a member for regulating pressure inside the combustion chamber of the gas generator, e.g. a gas leakage orifice that is opened or closed as a function of the pressure in the gas generator. This regulator member may be constituted in particular by the valve 50 itself, with the valve being configured to occupy a position in which the duct 40 is closed, but some of the gas contained in the combustion chamber can be diverted to the outside.

Figure 4:
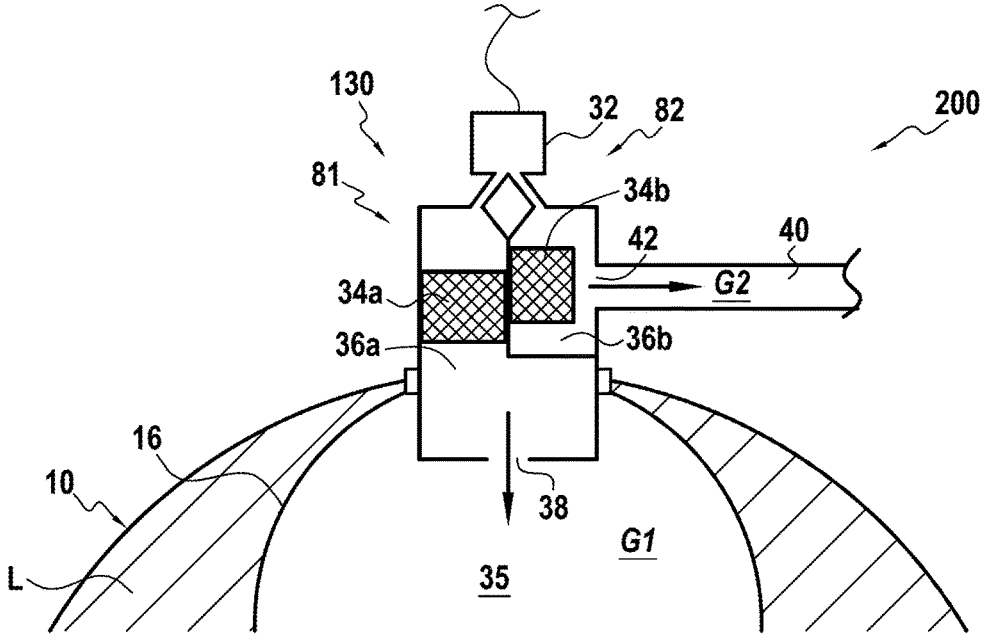
FIG. 4 is a fragmentary view of a spray device in a second embodiment of the invention.

FIG. 4 is a fragmentary diagram showing a spray device 200 in a second embodiment of the present invention.

Elements that are not shown should be taken as being identical to those described with reference to the first embodiment (FIGS. 1 to 3), and they are not described again.

The device 200 differs from the above-described device by the configuration of its gas generator 130.

As shown in FIG. 4, the gas generator 130 in this embodiment has a first gas generator unit 81 and a second gas generator unit 82, each having a respective combustion chamber 36*a*, 36*b* together with at least one respective pyrotechnic charge 34*a*, 34*b* received in each of said chambers 36*a*, 36*b*, and the gas generator 130 also has an ignitor 32 connected to both gas generator units 81 and 82 and adapted to cause the two pyrotechnic charges 34*a* and 34*b* to fire jointly.

In this example, the first combustion chamber 36*a* communicates with a pressurization chamber 35 inside the tank 10 via a through orifice 38. All of the gas G1 generated in the first combustion chamber 36 is delivered to the inside of the tank inside the pressurization chamber 35 defined by a transmission element 16 of the deformable membrane type identical to that of FIG. 1. As in the above-described first embodiment, the gas G1 contained in the pressurization chamber acts on the liquid L. In the embodiment shown, this action is indirect and takes place via the transmission element 16.

In this embodiment, the second combustion chamber 36*b* is connected to the nozzle 20 via a duct 40. Specifically, in this embodiment, the leakage orifice(s) 42 from the second combustion chamber 36*b* communicate(s) exclusively with the nozzle 20.

In other words, in this second embodiment, one combustion chamber is adapted to generate the gas G1 for pressurizing the liquid L and propelling it towards the ejector member 20, while the second combustion chamber, which is independent of the first, serves to feed the ejector member with gas G2.

In this way, the functions of expelling the extinguishing liquid and of supplying gas are decoupled. The first and second pyrotechnic charges may be selected independently of each other in order to satisfy constraints specific to their respective functions.

Advantageously, the second pyrotechnic charge may be constituted by a compound of the same type as those described in patent application WO 2009/095578, which generates nitrogen (an inert extinguishing gas), e.g. essentially comprising azodicarbonamide and a nitrogenous reducing charge, the first pyrotechnic charge then contributing to delivering the heat needed to make them decomposed.

Figure 5:
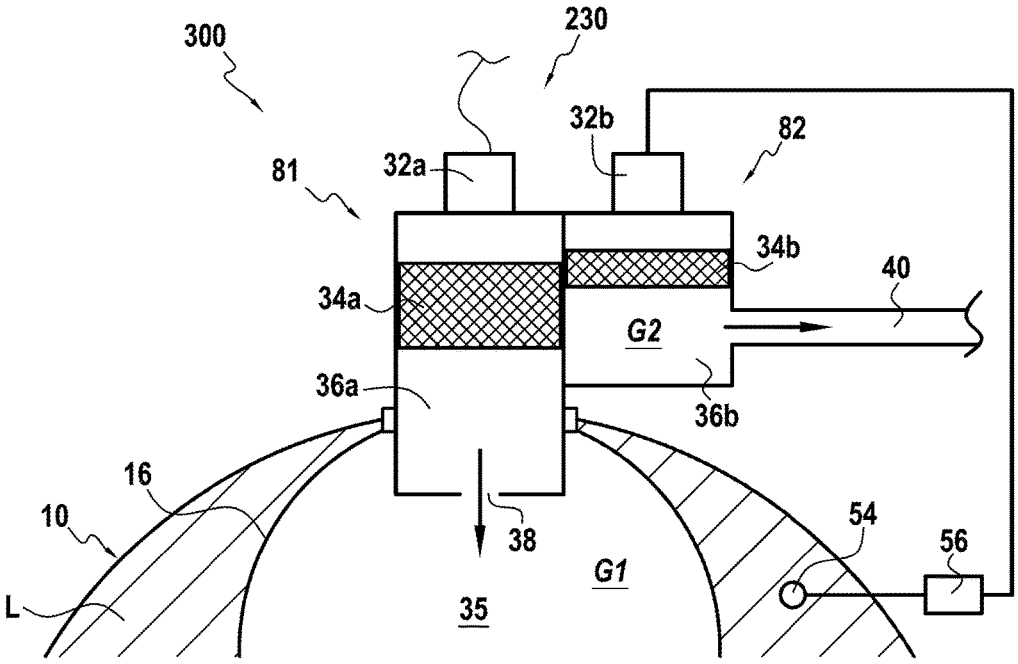
FIG. 5 is a fragmentary view of a spray device in a third embodiment of the invention.

FIG. 5 is a fragmentary diagram showing a spray device 300 in a third embodiment of the present invention.

Elements that are not shown and/or not described should be taken as being identical to those described with reference to the first and second embodiments (FIGS. 1 to 4).

The device 300 differs from the device of FIG. 4 solely by the fact that its pyrotechnic generator 230 has two distinct ignitors 32*a* and 32*b*, the first of the two ignitors being configured to ignite exclusively the first pyrotechnic charge(s) 34*a* situated in the first combustion chamber 36*a* of the first gas generator unit 81, and the second ignitor 42*b* being configured to ignite exclusively the second charge(s) 34*b* situated in the second combustion chamber 36*b* of the second gas generator unit 82.

It can be understood that the first and second ignitors may be triggered by a common control unit or by specific control units, in particular electrical control units.

Depending on requirements, the first and second ignitors may be triggered synchronously or asynchronously.

In general, it is preferable to trigger the ignitors in such a manner that the atomization gas reaches the nozzle slightly later than the liquid. Asynchronous triggering of the two ignitors, with a small delay in triggering the second ignitor, thus enables the pressure needed for the liquid in the tank (of the order of 5 bars to 10 bars) and for the nozzle (of the order of 5 bars) to be limited.

In the example shown in FIG. 5, a temperature sensor 54 is provided inside the tank 10, preferably in contact with the extinguishing agent L. A firing member 56 forming the control unit for the second ignitor 32*b* is connected to the temperature sensor 54 and to the above-described second ignitor 32*b*.

The second ignitor 32*b* igniting the second pyrotechnic charge 34*b* can thus be fired only if the temperature conditions to which the spray device 300 is subjected require the nozzle to operate under two-fluid conditions in order to ensure good atomization of the extinguishing agent L. Otherwise, it is not fired and the nozzle 20 then operates as a single-fluid nozzle that is fed only with the extinguishing agent.

Figure 6:
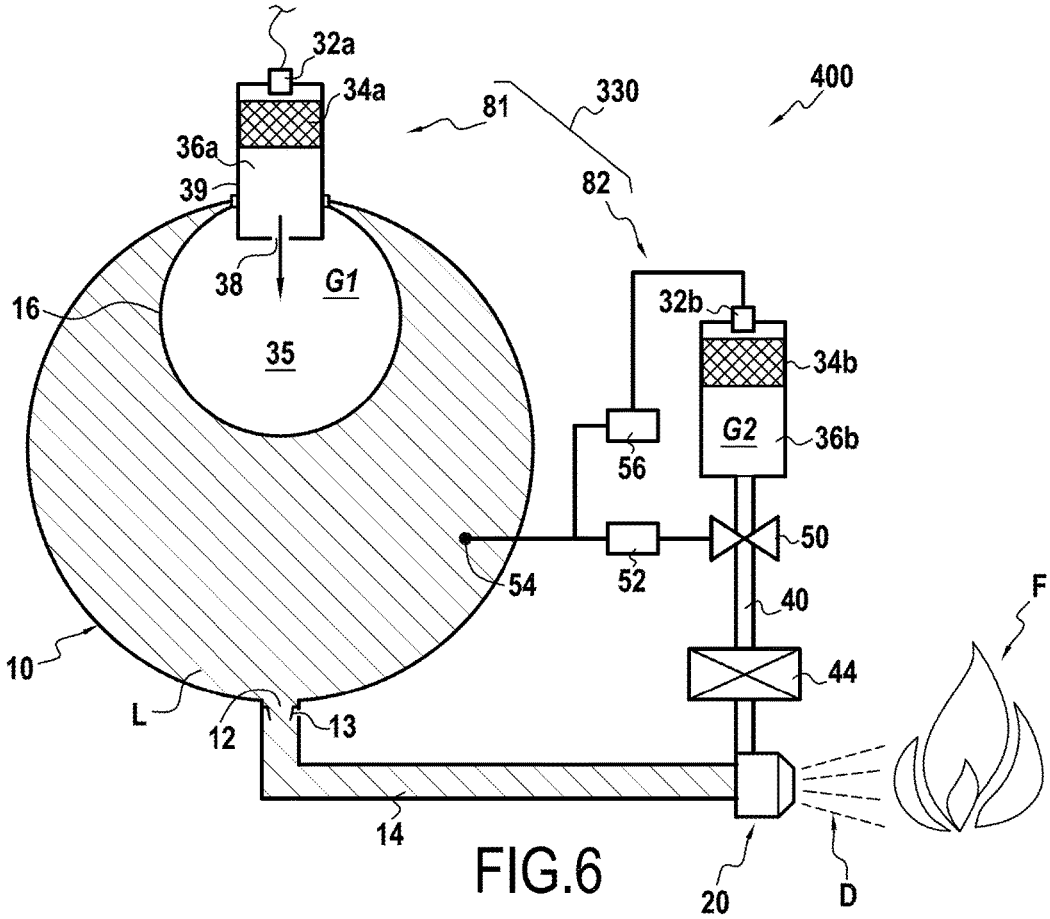
FIG. 6 shows a variant implementation of the third embodiment of the invention.

As shown in FIG. 6, the two gas generator units 81 and 82 and their respective ignitors 32*a*, 32*b* may also be spaced apart. All other aspects remain identical to those described with reference to FIG. 5.

The invention claimed is:

1. A spray device for spraying a liquid, the device comprising:

a tank containing the liquid for spraying;

at least one liquid ejector member in communication with the tank; and a pyrotechnic gas generator for pressurizing the liquid inside the tank and propelling it under pressure out from the tank;

wherein in at least one mode of operation, the ejector member is in communication with the gas generator in such a manner as to enable it to be fed directly with the gas generated by the gas generator;

wherein the gas generator has a first gas generator unit having a first combustion chamber housing at least one first pyrotechnic charge, and a second gas generator unit having a second combustion chamber housing at least one second pyrotechnic charge, the first gas generator unit being arranged in such a manner that the gas generated in the first combustion chamber acts on the liquid to pressurize it and to propel it out from the tank, and the second gas generator unit being arranged so that, in at least one mode of operation, the gas generated in the second combustion chamber directly feeds the liquid ejector member, wherein the pyrotechnic gas generator includes a first ignitor adapted to fire the first pyrotechnic charge, and a second ignitor adapted to fire the second pyrotechnic charge independently of the first.

2. A spray device for spraying a liquid, according to claim 1, wherein the ejector member is a nozzle.

3. A spray device according to claim 1, wherein the ejector member is a two-fluid nozzle.

4. A spray device according to claim 3, wherein the two-fluid nozzle is an internal mixer nozzle.

5. A spray device according to claim 3, wherein the two-fluid nozzle is an external mixer nozzle.

6. A spray device according to claim 1, wherein the first gas generator unit is located at least in part inside the tank.

7. A spray device according to claim 1, wherein the second gas generator unit is configured for the gas that is released to act directly on the liquid.

8. A spray device according to claim 1, wherein the first gas generator unit is configured for the gas to act indirectly on the liquid via a movable separator member.

9. A spray device according to claim 8, wherein the movable separator member is a deformable membrane.

10. A spray device according to claim 8, wherein the movable separator member is a slidable piston.

11. A spray device according to claim 1, further including a temperature sensor inside the tank and a control member controlling the actuation of the second ignitor as a function of the temperature value measured inside the tank.

12. A spray device according to claim 1, further including a valve for controlling the flow rate of gas delivered into the ejector member and a temperature sensor situated inside the tank, the valve being controlled as a function of the temperature measured by the sensor.

13. A spray device according to claim 8, wherein the movable separator member is a flexible membrane.

* * * * *